US012250999B2

(12) United States Patent
Il et al.

(10) Patent No.: US 12,250,999 B2
(45) Date of Patent: Mar. 18, 2025

(54) SLIDE FASTENER ELEMENTS, FASTENER STRINGERS, AND FASTENER CHAIN

(71) Applicant: YKK Corporation, Tokyo (JP)

(72) Inventors: Haruaki Il, Milan (IT); Tsutomu Saito, Milan (IT)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/261,384

(22) PCT Filed: Jan. 24, 2022

(86) PCT No.: PCT/JP2022/002475
§ 371 (c)(1),
(2) Date: Jul. 13, 2023

(87) PCT Pub. No.: WO2022/163592
PCT Pub. Date: Aug. 4, 2022

(65) Prior Publication Data

US 2024/0298755 A1 Sep. 12, 2024

(30) Foreign Application Priority Data

Jan. 28, 2021 (IT) ..... 102021000001706

(51) Int. Cl.
*A44B 19/08* (2006.01)
*A44B 19/40* (2006.01)

(52) U.S. Cl.
CPC ..... *A44B 19/08* (2013.01); *A44B 19/403* (2013.01)

(58) Field of Classification Search
CPC ..... A44B 19/08; A44B 19/403; A44B 19/02; A44B 19/04; A44B 19/06
See application file for complete search history.

(56) References Cited

U.S. PATENT DOCUMENTS 3,078,537 A * 2/1963 Morin ..... A44B 19/08 24/410
3,153,830 A * 10/1964 Morin ..... A44B 19/403 24/413

(Continued)

FOREIGN PATENT DOCUMENTS

CN 102793341 A 11/2012
GB 740 975 A 11/1955

(Continued)

OTHER PUBLICATIONS

International Search Report, PCT Patent Application No. PCT/JP2022/002475, Apr. 12, 2022, 5 pages.

(Continued)

*Primary Examiner* — Robert Sandy
(74) *Attorney, Agent, or Firm* — Kilpatrick Townsend & Stockton LLP

(57) ABSTRACT

A fastener element for a slide fastener includes: a coupling portion; and one single root portion either including, or being plastically bendable to include, a bent portion and a distal end portion which extends from the bent portion towards a side of the coupling portion which is closer to the fastener tape. Each face of the coupling portion includes an engaging protrusion protruding in a lengthwise direction, and an engaging recess recessed in a lengthwise direction with respect to the face, and is configured for receiving an engaging protrusion of a fastener element on the opposite stringer in a closed condition of the slide fastener.

17 Claims, 15 Drawing Sheets

(56) References Cited

U.S. PATENT DOCUMENTS

| | | | | |
|---|---|---|---|---|
| 4,078,278 | A * | 3/1978 | MacFee | A44B 19/34 24/412 |
| 7,426,772 | B2 * | 9/2008 | Himi | A44B 19/08 24/414 |
| 2008/0313867 | A1 | 12/2008 | Morioka et al. | |
| 2009/0013505 | A1 | 1/2009 | Hasegawa et al. | |

FOREIGN PATENT DOCUMENTS

| | | | |
|---|---|---|---|
| GB | 926 074 | A | 5/1963 |
| JP | H01-080012 | U | 5/1989 |
| JP | 2009-034495 | A | 2/2009 |
| KR | 2008 0112133 | A | 12/2008 |

OTHER PUBLICATIONS

Written Opinion, PCT Patent Application No. PCT/JP2022/002475, Apr. 12, 2022, 4 pages.
Search Report, Italian Patent Application No. 102021000001706, Oct. 18, 2021, 8 pages.

* cited by examiner

SLIDE FASTENER ELEMENTS, FASTENER STRINGERS, AND FASTENER CHAIN

TECHNICAL FIELD

The present invention generally relates to slide fasteners. More particularly, the present invention relates to a fastener element. Stringers made with the fastener elements of this disclosure may be used either for concealed slide fasteners or slide fasteners whose elements remain visible from the outside.

BACKGROUND ART

As known, a slide fastener includes a pair of tapes laid flat. The fastener tapes each have inner facing edges where commonly cords are formed and fastener elements (or teeth) are attached to the cords and the inner edges of the fastener tapes. When the edges are drawn closer to each other by the action of a slider on the respective elements, these elements are forced to interdigitate with each other. Tapes with elements attached in this manner are known as stringers. When two stringers are combined together, they are known as a chain. A slide fastener generally includes a chain, at least one slider, and in many cases a top stop, a bottom stop or both are also attached to the chain. When a slide fastener is to be opened or closed, the user normally takes hold of a pull-tab linked to the slider and pulls the slider forward or backwards. This will close or open the slide fastener, depending on the direction of travel of the slider.

The present invention relates to a fastener element that shares several features in common with conventional fastener elements used in concealed slide fasteners. In use, the front or the back of the chain of a slide fastener can be exposed. In many cases where the elements are discretely attached to a stringer, that is when individual elements made of metal or plastic are for example, crimped (commonly in the case of metal) or as another example, injection molded (commonly in the case of plastic), the user will not notice a difference in the shape of elements that are symmetrical about the tape whichever side is exposed. However, when the slide fastener includes continuous elements, that is when the elements of a stringer sewn to the edge of the tape include a coil or spiral, the elements may be entirely situated on either the outward side or the inward side of the tape. Even in this circumstance, when elements are situated on the inward side of the slide fastener, they can be seen. By folding the tape back over the continuous elements and sewing it in place, it is possible to more completely conceal elements. Such concealed slide fasteners are well known in the art. A similar technique of folding back the tape of a stringer can be used with elements that are discretely attached to a tape. Generally, the elements of this kind of slide fastener are not exposed, i.e. not visible from the outside when they are in a closed condition and orientated so that the tape of the respective stringers cover them. Alternatively, this manner of attaching elements to a stringer allows for a greater exposure of the element surfaces if the slide fastener is used with the elements on the visible surface. Typically, these styles of concealed slide fasteners are applied to high-grade clothes such as jackets.

Patent Literature 1 discloses a slide fastener element for a concealed slide fastener. The element has an overall hook-shape and includes a coupling portion and a root portion. The root portion includes a bent portion with a Major arc shaped groove that is clamped to a cord and an edge portion of a fastener tape. The coupling portion is configured for engaging two consecutive fastener elements of an opposite stringer. The coupling portion has two opposite faces, one of which provides an engaging protrusion, while the opposite face provides an engaging recess. The engaging protrusion and the engaging recess are configured for coupling respectively with an engaging recess and an engaging protrusion provided on two respective fastener elements fitted on the opposite stringer.

With the above-mentioned conventional type of fastener tape, the slider moves smoothly in one direction, and not so smoothly in the opposite direction.

CITATION LIST

Patent Literature

Patent Literature 1: CN102793341A

SUMMARY OF THE INVENTION

Technical Problem

It is an object of the present invention to provide a slide fastener element for forming a high-quality slide fastener along which the slider may move smoothly in either direction, both when closing and when opening the slide fastener.

Another object of the present invention is to form slide fasteners with conspicuous metal elements having a shiny, metallic appearance. This aspect meets a demand in certain kinds of clothing, for example leather jackets or bags, where the elements of a slide fastener are meant to be clearly visible from the outside and confer an aesthetic value to the article on which it is applied.

Solution to Problem

According to an aspect, the present invention provides a slide fastener element for a slide fastener as defined in claim 1. According to an aspect of the present invention, embodiments provide that the fastener element has a coupling portion and one single root portion, which extends from the coupling portion. The root portion forms a Major arc shaped groove (that is, a groove shaped as an arc of a circle having a measurement greater than or equal to 180 degrees) for receiving and holding a length of a cord and an edge portion of a fastener tape. The coupling portion has two opposite faces in a lengthwise direction. Each face of the coupling portion includes an engaging protrusion protruding in a lengthwise direction, and an engaging recess recessed in a lengthwise direction with respect to the relevant face, and is configured for receiving an engaging protrusion of a fastener element on the opposite stringer in a closed condition of the slide fastener.

The root portion of a fastener element, as defined hereabove, in an undeformed state prior to it being attached to a tape, is substantially straight and does not yet form the Major arc shaped groove. According to another aspect of the present invention, embodiments may provide a fastener element for a slide fastener, the fastener element having one single root portion which is plastically bendable to form a Major arc shaped groove for receiving and holding a length of a cord and an edge portion of a fastener tape, whereby the root portion is plastically bendable to include a bent portion, and a distal end portion which extends from the bent portion towards a side of the coupling portion which is closer to the fastener tape; the fastener element further includes a coupling portion extending from the root portion and having two opposite faces in a lengthwise direction. Each face of the coupling portion includes an engaging protrusion protruding in a lengthwise direction, and an engaging recess recessed in a lengthwise direction with respect to the relevant face, and is configured for receiving an engaging protrusion of a fastener element on the opposite stringer in a closed condition of the slide fastener.

Preferably, the coupling portion includes a body portion connected to the root portion, and a distal plate portion extending from the body portion and providing the two opposite faces with the engaging protrusions and the engaging recesses. The root portion has a first lengthwise thickness and the distal plate portion has a second lengthwise thickness that is less than the first lengthwise thickness of the root portion. Preferred embodiments of the fastener element are defined in the dependent claims.

Due to the provision of engaging protrusions and corresponding engaging recesses on both of the opposite faces of the coupling portions of the elements, the number of engaging protrusions and recesses is doubled with respect to an element of known design for a concealed slide fastener. The increased distribution and subdivision of the zones of contact between the elements favours a smoother action of the slider along the stringers. The symmetrical shape of the two opposite faces of a same fastener element provides the same smooth action both when closing and when opening the slide fastener. The pitch between two fastener elements on a same stringer is reduced with respect to the related art, whereby the gap between two consecutive elements is shorter, i.e. the elements on a same stringer are closer to one another, as compared to the related art. Due to the fact that elements are fitted more densely, the visible surface of the elements of the slide fastener has a more uniform, shiny metallic appearance. This aesthetic effect may be desired if the slide fastener is not used as a concealed slide fastener.

By way of example, embodiments of a slide fastener element according to the present invention will now be described with reference to the following accompanying drawings.

DESCRIPTION OF EMBODIMENTS

Figure 1:
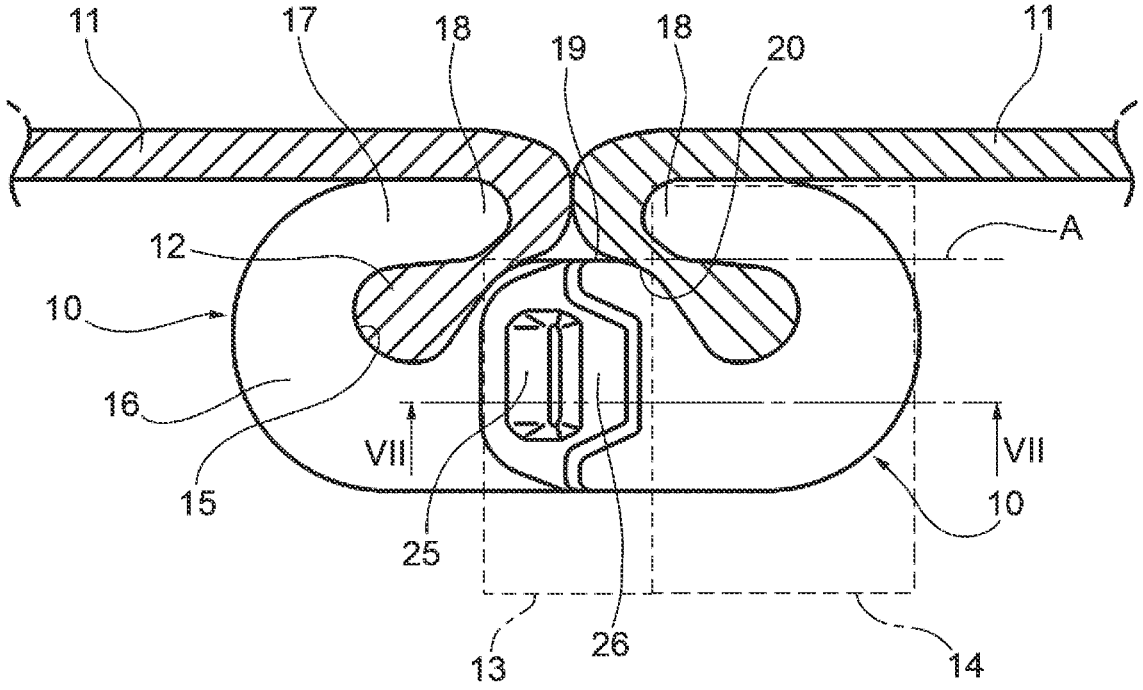
FIG. 1 is a cross-sectional view of a fastener chain with fastener elements according to a first embodiment of the present invention.

Referring to the drawings, a fastener element for a fastener tape is designated at 10. The fastener element, or "element", is preferably made of metal alloy and has an overall substantially hook-shape. That is, the element is curved in the vertical plane so that when attached, both transversal ends of the element face the same direction. The element 10 is clamped in a per se known manner, as described herein after with reference to FIG. 2 and FIG. 3, to a cord 12 and a fastener tape 11 which extend in a lengthwise direction.

In this context, the term "lengthwise direction" designates the direction in which the fastener tape extends and the direction of movement of a slider along the slide fastener. Also, a direction that lies on the surfaces of the fastener tapes and perpendicular to the lengthwise direction is defined as the "transversal" direction or the "width" direction. Terms such as "front", "forward" or "headward" and "back" "tailward" or "rear" refer to the direction in which a slider is relatively moved with respect to the rows of the fastener elements in order to engage and disengage the rows of the fastener elements. When a slider is drawn along the elements in a "front" "forward" or "headward" direction, the elements are forced to interdigitate and so attach to each other, whereas when the slider moves in a backward, tailward or rear direction, the elements open, that is, become detached from each other. The direction that is perpendicular to the lengthwise and transversal directions is defined as the "vertical" direction. The term "thickness", in this context, will generally refer to a length in the lengthwise direction.

The fastener element includes a coupling portion (or head portion) 13, and one single root portion 14. The coupling portion 13 is configured for engaging two consecutive fastener elements of an opposite stringer. The root portion 14 extends from the coupling portion 13 and forms a Major arc shaped groove 15 for receiving and holding a length of the cord 12 and an edge portion of the fastener tape 11, in a closed condition obtained when attached to a stringer in the slide fastener. In this context, the root portion 14 is defined as being one single root portion, meaning that the root portion does not bifurcate in order to clamp the tape and cord between two clamp portions of the root portion.

The root portion 14 includes a bent portion 16, forming a bend preferably including 180 degrees, and a distal end portion 17, which extends substantially along a line in a transversal plane from the bent portion 16 towards a side of the coupling portion 13 which is closer to the fastener tape (FIG. 1).

Figure 2:
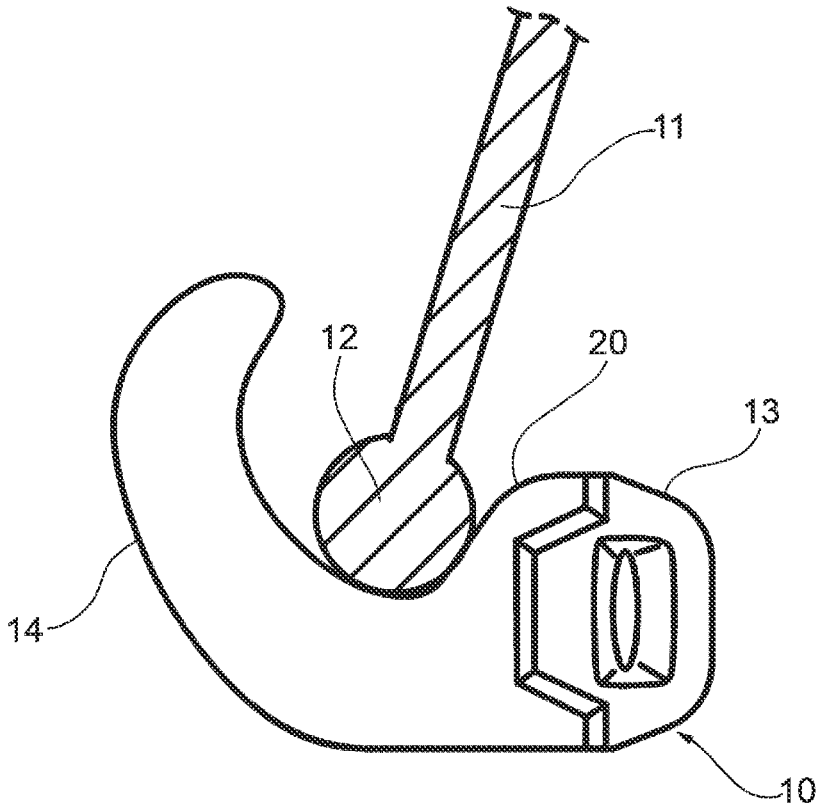
FIG. 2 is an explanatory view schematically showing how a fastener element may be attached to a fastener tape and its cord.
Figure 3:
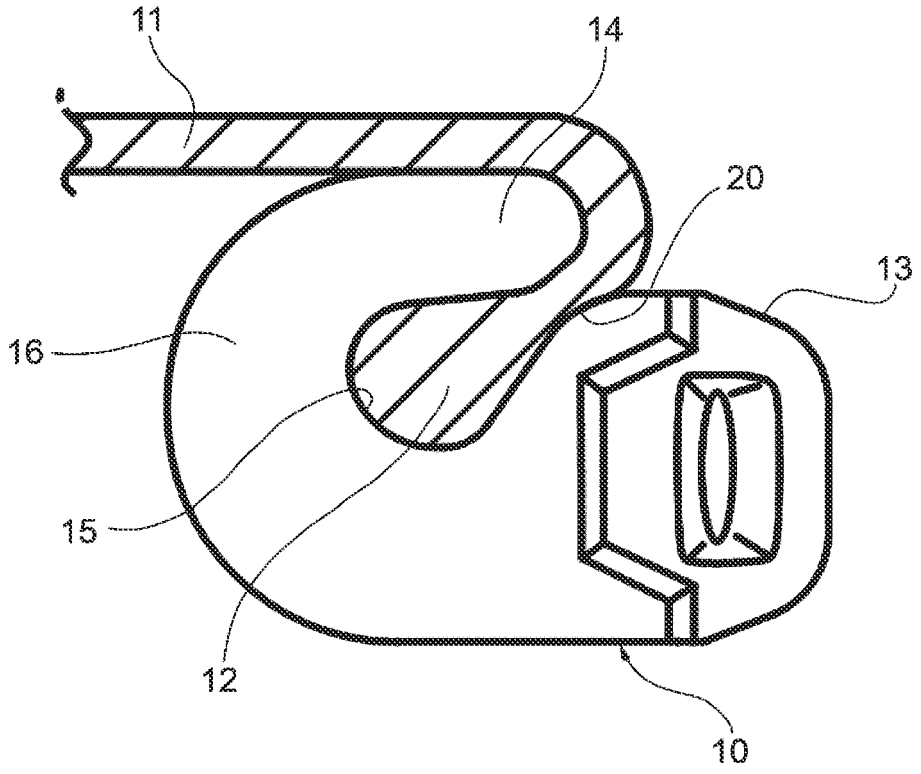
FIG. 3 is an explanatory view schematically showing how a fastener element may be attached to a fastener tape and its cord.

As shown in FIG. 2, the cord 12 of a tape 11 is placed on one side of an element 10 where the root portion 14, initially straight (or substantially straight), meets the coupling portion 13. The root portion 14 of the element 10 is then curved in a vertical plane towards the coupling portion 13, and enveloping the cord so that when attached, both transversal ends of the element face the same direction (FIG. 3). The bending action forms the bending portion 16 and the Major arc shaped groove 15 that receives tightly a length of the cord 12, while a length of an edge portion of the fastener tape 11 is clamped or nipped between the distal end portion 17 of the root portion 14 and a convex side surface 20 of the coupling portion facing the fastener tape.

The embodiments illustrated in the drawings and described herein refer to a fastener element whose root portion 14 has been bent in order to clamp a portion of the cord and an edge portion of the fastener tape. It will be appreciated that in an undeformed state prior to attaching the element to a tape, the root portion may be straight, or substantially straight, and have the potential to form the Major arc shaped groove 15 and the bent portion 16 on deformation.

The distal end portion 17 extends forming a tip 18 located in a position overpassing a geometrical straight-line A oriented in the transversal direction and tangent to a side surface 19 of the coupling portion 13 closer to the fastener tape.

The coupling portion 13 includes a body portion 21, connected to the root portion 14, and a distal plate portion 22 extending from the body portion 21. Preferably, the body portion 21 has a lengthwise thickness T (FIG. 7) which is equal to the lengthwise thickness T of the root portion 14. Preferably, the distal plate portion 22 has a lengthwise thickness t that is less than the lengthwise thickness T of the root portion 14.

The distal plate portion 22 has two opposite faces 23, 24, facing opposite directions in the lengthwise direction. Each face 23, 24 provides an engaging protrusion 25, protruding in a lengthwise direction from a respective one of the two opposite faces 23, 24, and an engaging recess 26, recessed in a lengthwise direction with respect to the relevant face, configured for receiving an engaging protrusion 25 of a fastener element on the opposite stringer. Preferably, the faces 23, 24 have parallel flat surfaces, perpendicular to the lengthwise direction.

Advantageously, the element 10 has a symmetrical shape with respect to a midplane M (FIG. 7) extending through the center of the element and perpendicular to the lengthwise direction.

Preferably, the engaging protrusion 25 is shaped as a vertically elongate crest raising respectively from each face 23, 24, with a top ridge 53, a distal slope 27 facing towards a distal edge 28 of the distal plate portion 22, and a proximal slope 29 facing the body portion 21.

Advantageously, in order to have a smoother engaging action into and disengaging action out of the engaging recess of an opposite element, the proximal slope 29 is more inclined than the distal slope 27 with respect to the face 23 or 24 from which the engaging protrusion 25 raises.

Preferably, the engaging protrusion 25 is spaced from the distal edge 28, whereby each surface of the face 23, 24 surrounds the engaging protrusion 25 and a flat strip surface 30 is provided between the distal slope 27 and the distal edge 28 of the distal plate portion 22.

The lengthwise thickness of the fastener element 10, measured at the engaging protrusions 25, may be equal or slightly greater or slightly less than the lengthwise thickness T of the root portion 14. In the exemplary embodiment depicted in FIG. 7, the lengthwise thickness of the fastener element, measured at the engaging protrusions 25, is slightly greater than the lengthwise thickness of the root portion 14.

On either opposite face of the coupling portion, the engaging recess 26 is shaped to accommodate a respective engaging protrusion 25 of an adjacent fastener element 10 attached to the opposite stringer of the slide fastener, in a closed condition of the slide fastener.

The engaging recess 26 is defined at a position between the body portion 21 and the engaging protrusion 25 and a bottom surface 31, which is part of face 23 or 24 included between the body portion 21 and the engaging protrusion 25.

A connecting wall 32 joins the thicker body portion 21 to the narrower distal plate portion 22. The connecting wall 32 extends from a side of the coupling portion 13 closer to the fastener tape to a vertically opposite side of the coupling portion 13 farther from the fastener tape. Preferably, the connecting wall 32 is sloping toward the distal edge 28 of the distal plate portion 22.

Embodiments may provide that the connecting wall 32 defines two side extensions 33, 34 of the body portion 21 extending toward the distal plate portion 22. The engaging recess 26 may therefore be defined at a position between the engaging protrusion 25, and the connecting wall 32, particularly between the side extensions 33, 34, a central part 35 of the connecting wall 32 that joins the side extensions 33, 34, and the bottom surface 31.

In the exemplary embodiment shown in FIG. 1, the engaging recess 26 has a substantially trapezium shape when viewed along a lengthwise direction, with two parallel bases defined by the engaging protrusion 25 and the central part 35 of the connecting wall 32, and with two sloping sides 36, 37 defined by the side extensions 33, 34, respectively. Two passages 38, 39 may be formed on each face 23, 24 between each one of side extensions 33, 34 and the engaging protrusion 25.

Figure 9:
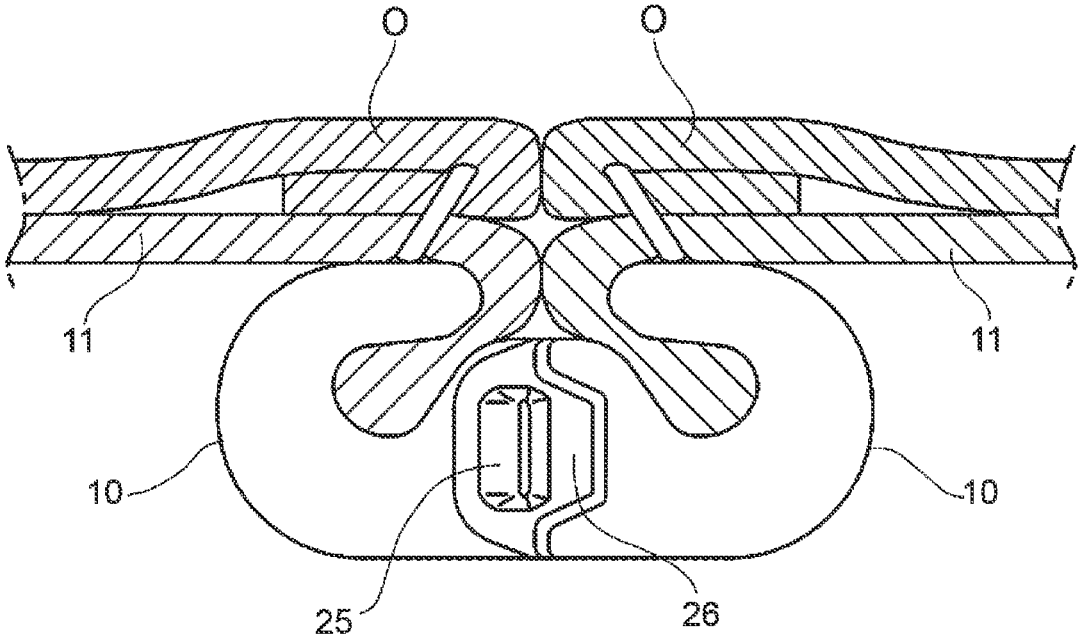
FIG. 9 is a cross-sectional view of a fastener chain with fastener elements according to the first embodiment of the present invention in an arrangement in which the fastener elements are concealed.
Figure 10:
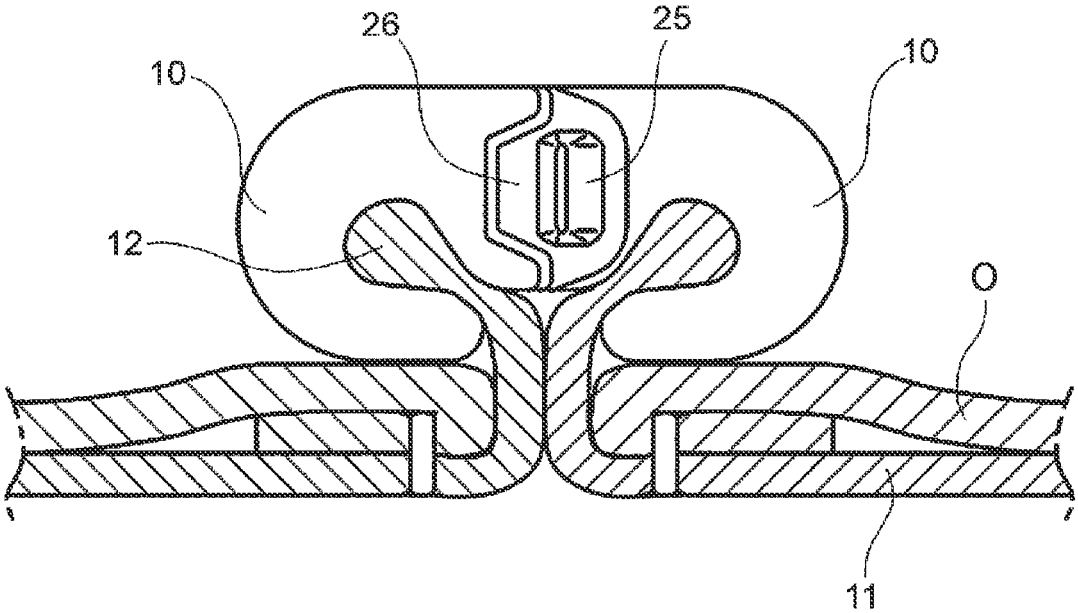
FIG. 10 is a cross-sectional view of a fastener chain with fastener elements according to the first embodiment of the present invention in an arrangement in which the fastener elements are exposed.

The fastener element 10 may be used either for fastener stringers in which the fastener elements are visible, or are concealed. FIG. 9 shows a usage example in which the fastener elements are concealed, and an outer side of the article O (for example of fabric) is toward the top of the drawing, whereas the inside of the article is toward the bottom of the drawing. Conversely, FIG. 10 shows another usage example in which the fastener elements are exposed, and the outer side of the article O is toward the top of the drawing.

Figure 6:
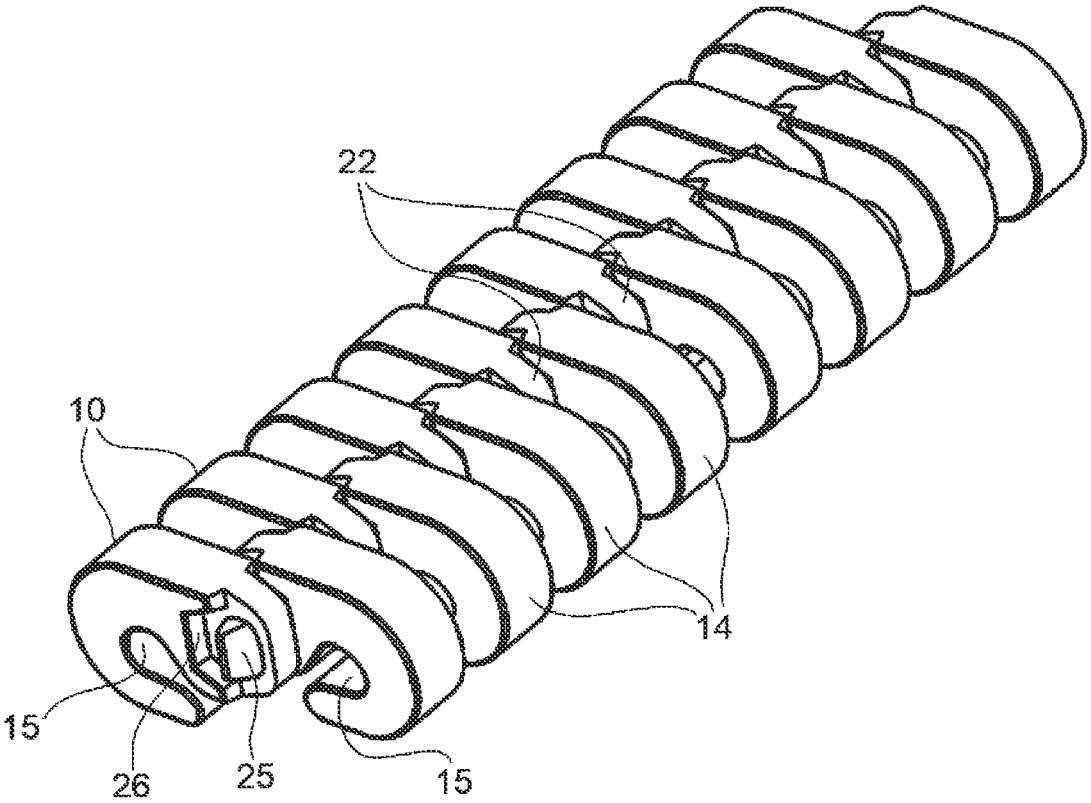
FIG. 6 is a perspective view of the elements of FIG. 5 with the coupled elements inverted.
Figure 7:
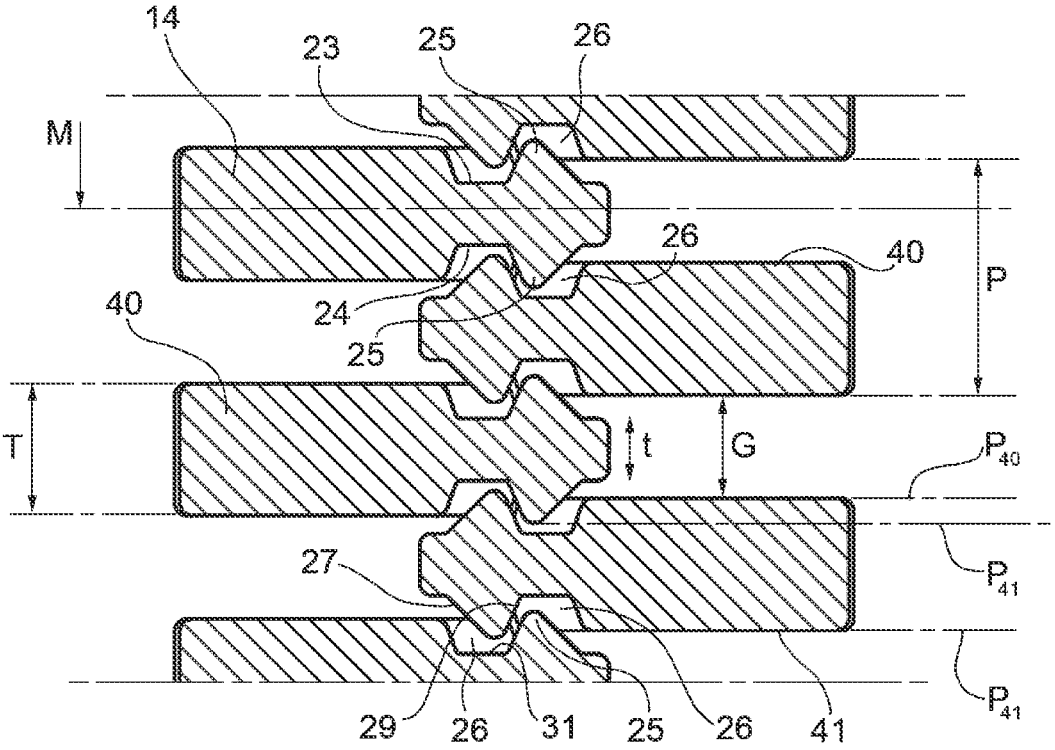
FIG. 7 is a cross-sectional view taken along the line VII-VII in FIG. 1.
Figure 8:
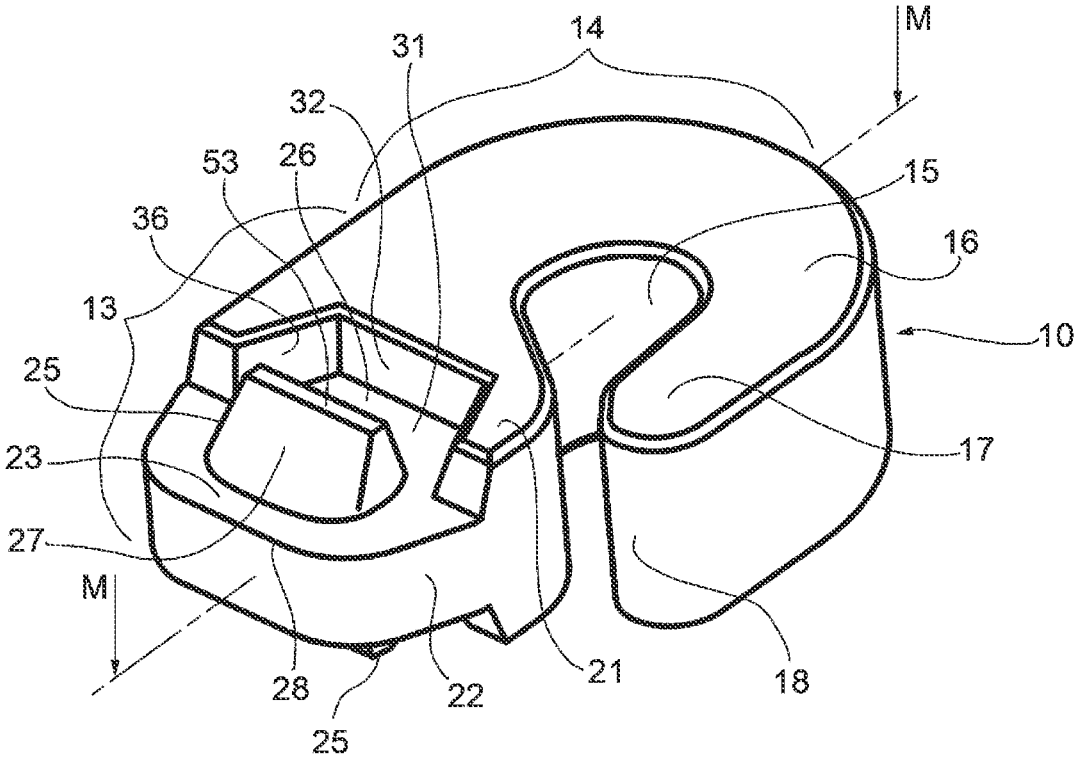
FIG. 8 is a perspective view of a first embodiment of a fastener element according to the present invention.

Since the lengthwise thickness t of the distal plate portion 22 is less than the lengthwise thickness T of the body portion 21 and the root portion 14 (FIG. 7), and the engaging protrusions 25 and engaging recesses 26 are provided on both sides of the coupling portions 13, the elements can be arranged along the fastener tapes (FIG. 6) more closely as compared to the related art, i.e. with a shorter lengthwise pitch P (FIG. 7). The lengthwise gap G (FIG. 7) between two consecutive elements 10 of a same row of elements can be reduced with respect to a conventional fastener tape.

As shown in FIG. 7, embodiments may provide that the geometrical plane P41', in which one of two opposite surfaces 40, 41 of a root portion 14 of an element lies, extends between the geometrical planes P40 and P41 in which the two opposite surfaces 40, 41 of a root portion 14 of a fastener element on the opposite stringer lie. The shorter lengthwise gap G entails a greater percentage of visible metal surface of the fastener elements, which meets aesthetic requirements for zippers to have a shiny, metallic appearance (FIG. 6).

Figure 4:
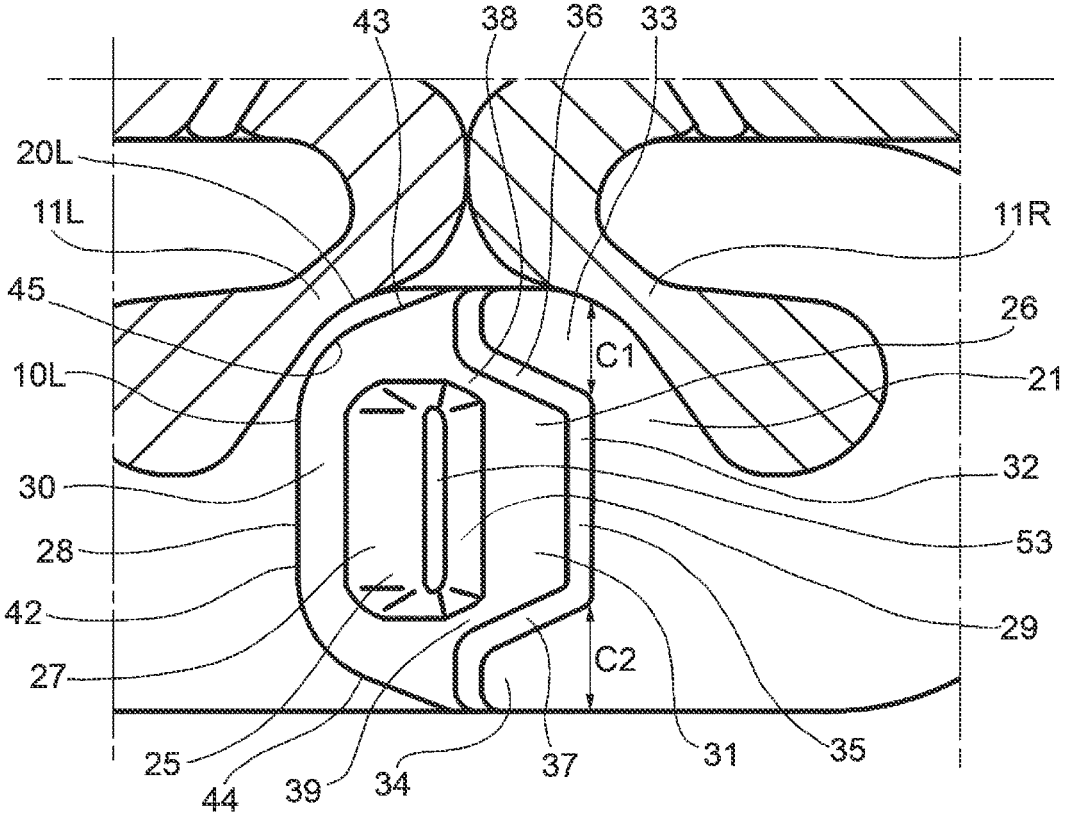
FIG. 4 is an enlarged view of a detail of FIG. 1.
Figure 5:
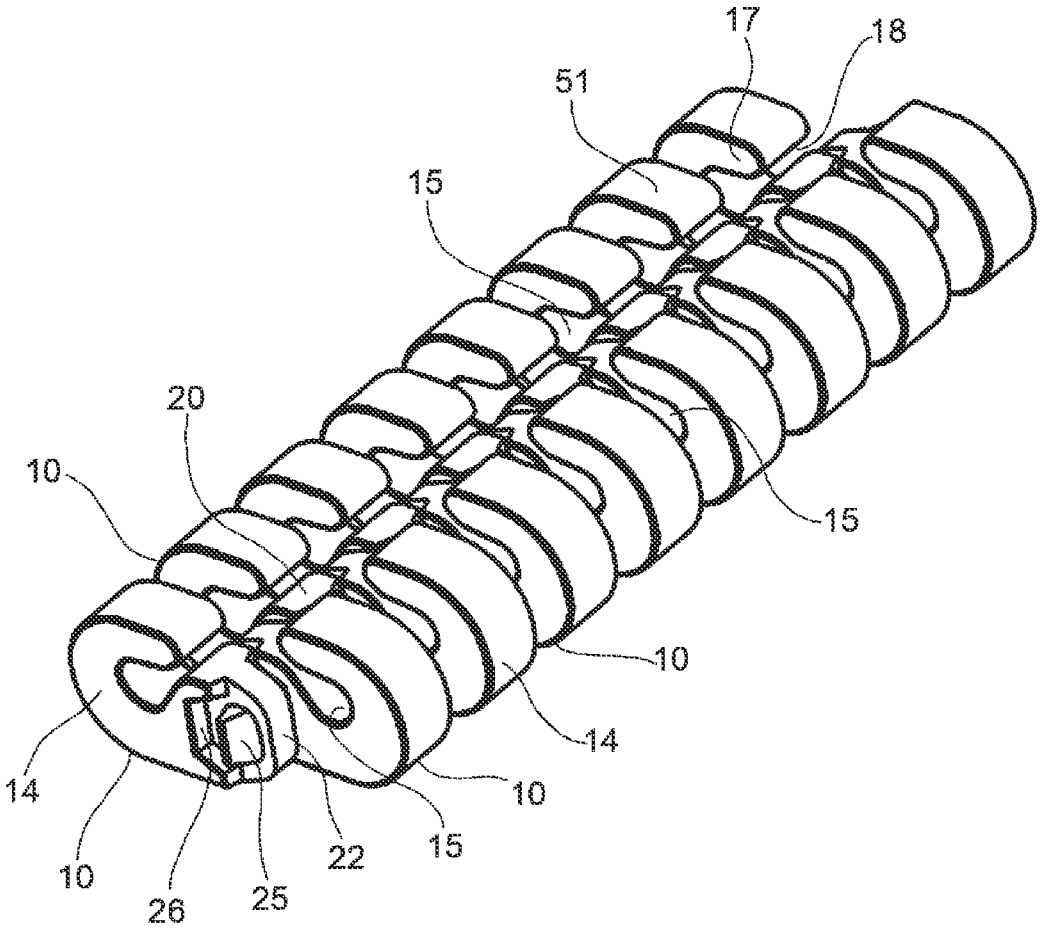
FIG. 5 is a perspective view showing the elements of a fastener chain from a side which is normally concealed by the fastener tapes, which have been removed to show the elements in a coupled condition.

As shown in FIG. 4, the distal plate portion 22 has a distal edge 28 with a substantially straight central edge part 42 and two inclined side edge parts 43, 44, that converge into the central edge part 42, tapering from the body portion 21. The inclined side edge part 43 located toward the fastener tape 11 is radiused to the straight central edge part 42, forming a radius 45. The convex side surface 20 of the coupling portion 13, particularly of the body portion 21, facing the fastener tape, protrudes vertically, in a vertical direction toward the fastener tape, more than the inclined side edge part 43 of the distal plate portion located towards the fastener tape. Reference is made to FIG. 4, which shows the inclined side edge part 43 of an element 10 fixed to a right-side tape 11R and a convex side surface 20L of the adjacent element 10L, fixed to the left side fastener tape 11L. Due to this arrangement, in the coupled condition of the slide fastener, the fibres between two elements on one tape (the left tape 11L in FIG. 4) are not compressed by the inclined side edge parts 43 of the elements fixed to the other fastener tape (the right tape 11R in FIG. 4). As a result, loose fibres of the fastener tapes are allowed to expand into the space between two consecutive elements of the same stringer. This feature gives the fastener tape as a whole an improved flexibility, despite the fact that the elements are fitted more densely along the fastener tapes.

In some embodiments, the fibres of a fastener tape between two elements on one tape may be clear of (i.e. spaced from) the coupling portions of the elements of the opposite tape (as shown in FIG. 4). In other embodiments, the fibres between two elements on one tape may touch the inclined side edge part of the coupling portions of the elements of the opposite stringer. However, due to the tapered contour of the inclined side edges, the fibres of the fastener tape will not be compressed. In either case, as a result, the friction between the fastener tape of one stringer against the elements of the other stringer is reduced.

Embodiments may provide that, in the body portion 21 of a coupling portion 13 (FIG. 4), the side extension 33 which is closer to the fastener tape 11 has a thickness C1, measured in the vertical direction, which is less than the vertical thickness C2 of the side extension 34 that is farther from the fastener tape (C1<C2). More specifically, the thicknesses C1 and C2 indicated in FIG. 4 are the vertical thicknesses measured at the position of the central part of the connecting wall, i.e. at the part of the engaging recess which is farthest from the distal edge of the coupling portion.

According to a second embodiment (FIGS. 11 and 12), in order to reduce the friction between the elements 10 and the slider (not shown), a side portion of the coupling portion 13 farthest from the fastener tape 11 may be made smaller than the side of the same coupling portion closer to the fastener tape. Specifically, a vertical distance W2 between the engaging protrusion 25 and the inclined side edge part 43 of the coupling portion closer to the fastener tape is longer than the vertical distance W1 between the engaging protrusion 25 and the inclined side edge part 44 of the coupling portion farthest from the fastener tape (W1<W2).

As compared to the first embodiment (FIG. 1), in the second embodiment (FIGS. 11 and 12) the inclined side edge part 44 of the coupling portion 13 farthest from the fastener tape extends from a point 46 of the body portion further away from the distal edge 28 of the coupling portion. In other words, the coupling portion 13 has a side facing away from the fastener tape which may be entirely formed as a slope which extends from the root portion 14 to the distal edge 28 of the distal plate portion 22.

Figure 12:
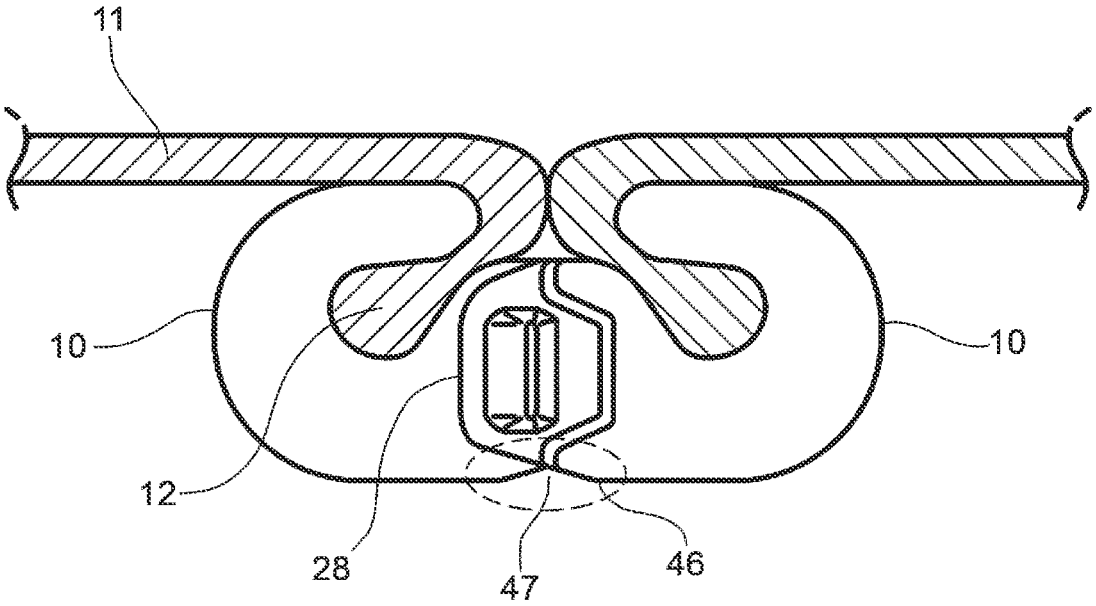
FIG. 12 is a cross-sectional view of a fastener chain formed by the two fastener stringers of FIG. 11 in a coupled condition.

As a result, when the two stringers are in a coupled condition, an indentation 47 having the shape of an obtuse angle is formed in the contour of the elements on the two stringers on the side of the elements farther from the fastener tapes, when viewed in the lengthwise direction (FIG. 12). The indentation reduces the contact surface and interference between the slider and the fastener elements, and therefore a smoother sliding action of the slider is achieved.

Figure 11:
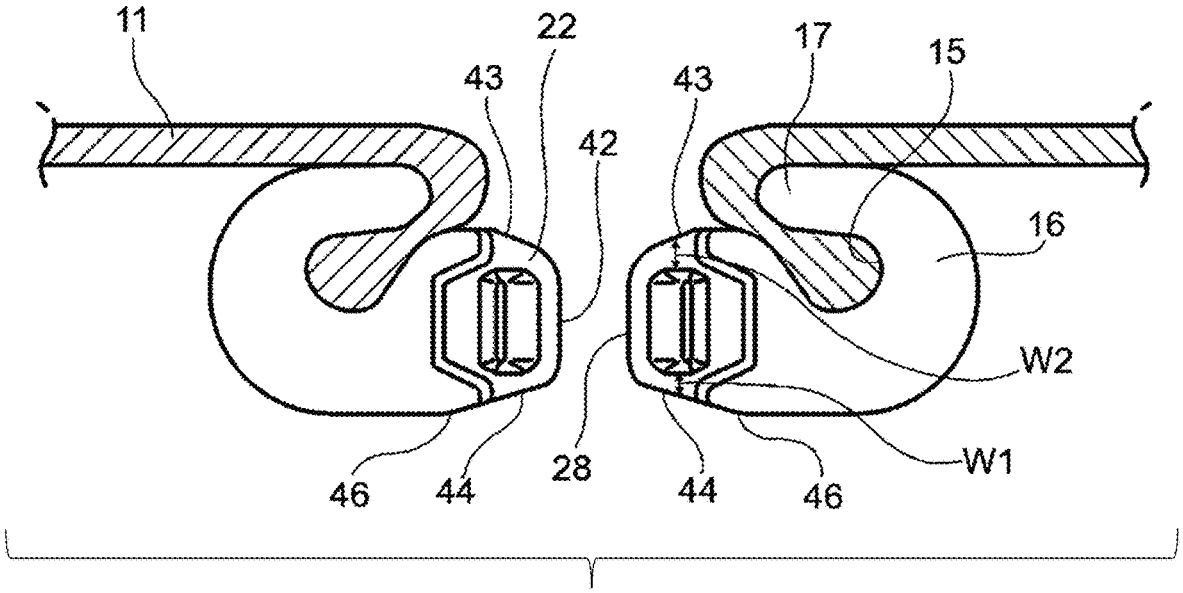
FIG. 11 is a cross sectional view of two stringers with fastener elements according to a second embodiment of the present invention.

Still with reference to FIGS. 11 and 12, embodiments may provide that the coupling portion 13 has an asymmetrical design in that the engaging protrusion 25 is arranged nearer to an inclined side edge part 44, facing away from the fastener tape, and is farther way from the side edge part 43 which is on the side of the fastener tape.

Embodiments may provide that the distal plate portion 22 tapers as it extends from a point beyond the engagement recess toward the distal edge 28.

Figure 13:
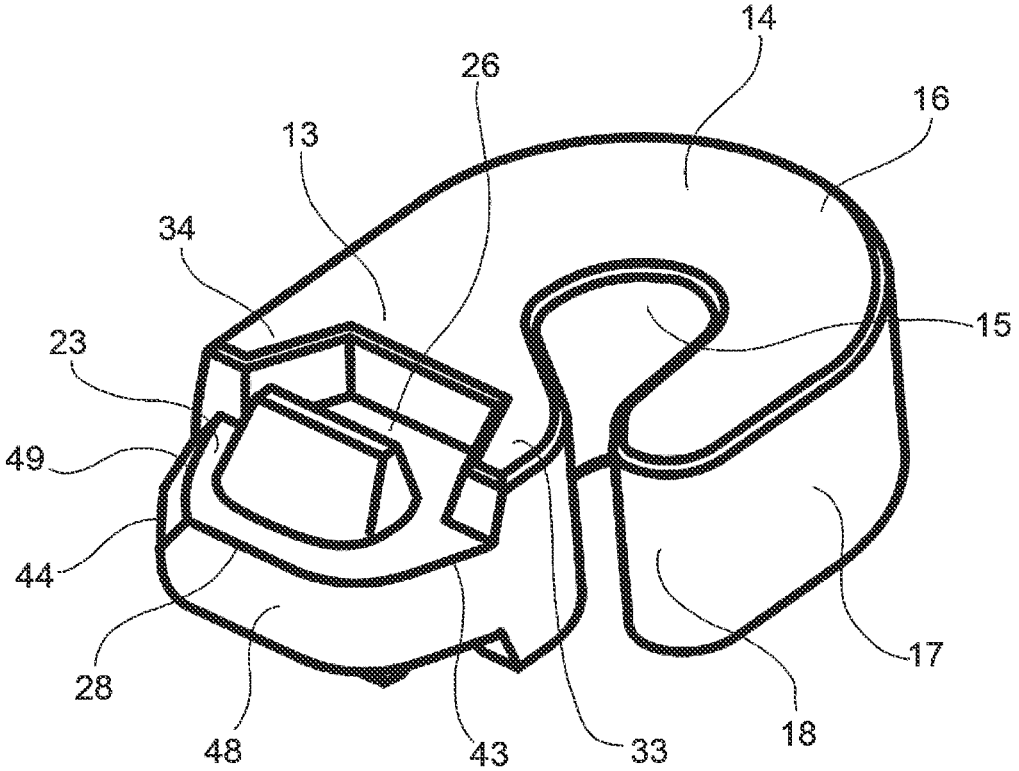
FIG. 13 is a perspective view of a second embodiment of a fastener element according to the present invention.
Figure 14:
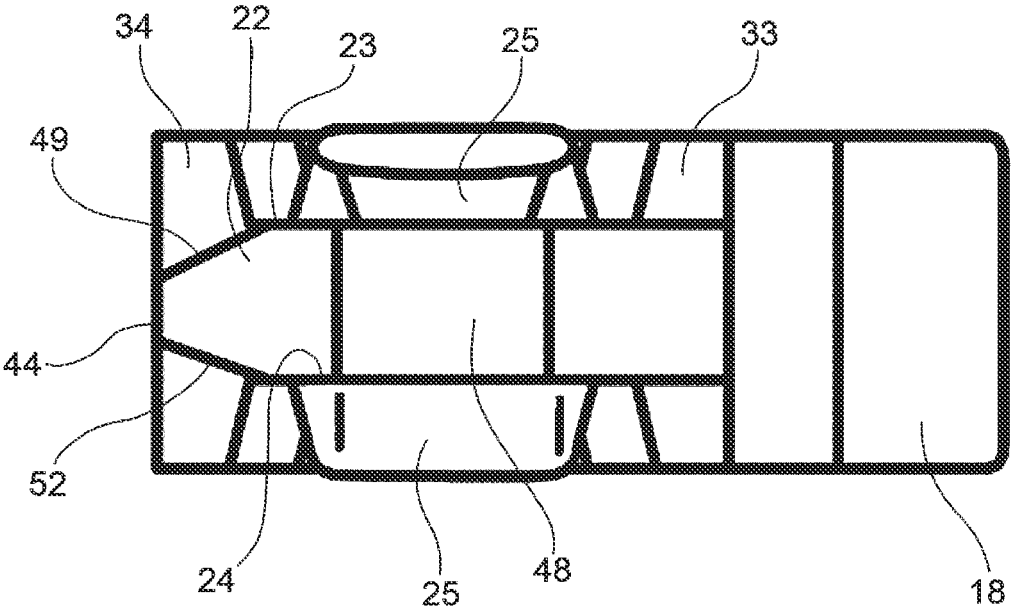
FIG. 14 is a cross-sectional view of the fastener element of FIG. 13.

Alternative embodiments may provide that, as shown in FIGS. 13 and 14, one or two chamfers are formed on the side of the coupling portion 13 farther away from the fastener tape. Designated 48 is a side shaped surface extending in the lengthwise direction along the contour of the distal plate portion 22, specifically along the central edge part 42 and the two inclined side edge parts 43, 44. A first chamfer 49 may be formed by reducing the lengthwise thickness of the distal plate portion 22 along the inclined side edge part 44 of the coupling portion farthest from the fastener tape. The first chamfer 49 joins the side shaped surface 48 to one (23) of the two opposite faces 23, 24 of the distal plate portion 22 and reduces the area of the element which may come in contact with the slider. Therefore, a smoother sliding action of the slider may be achieved.

Embodiments may provide that, as shown in FIG. 14, a second chamfer 52 may be formed by reducing the lengthwise thickness of the distal plate portion 22 along the inclined side edge part 44 of the coupling portion farthest from the fastener tape. The chamfer 52 joins the side shaped surface 48 to the opposite face 24 of the distal plate portion 22 and further reduces the area of the element which may come in contact with the slider.

Figure 15:
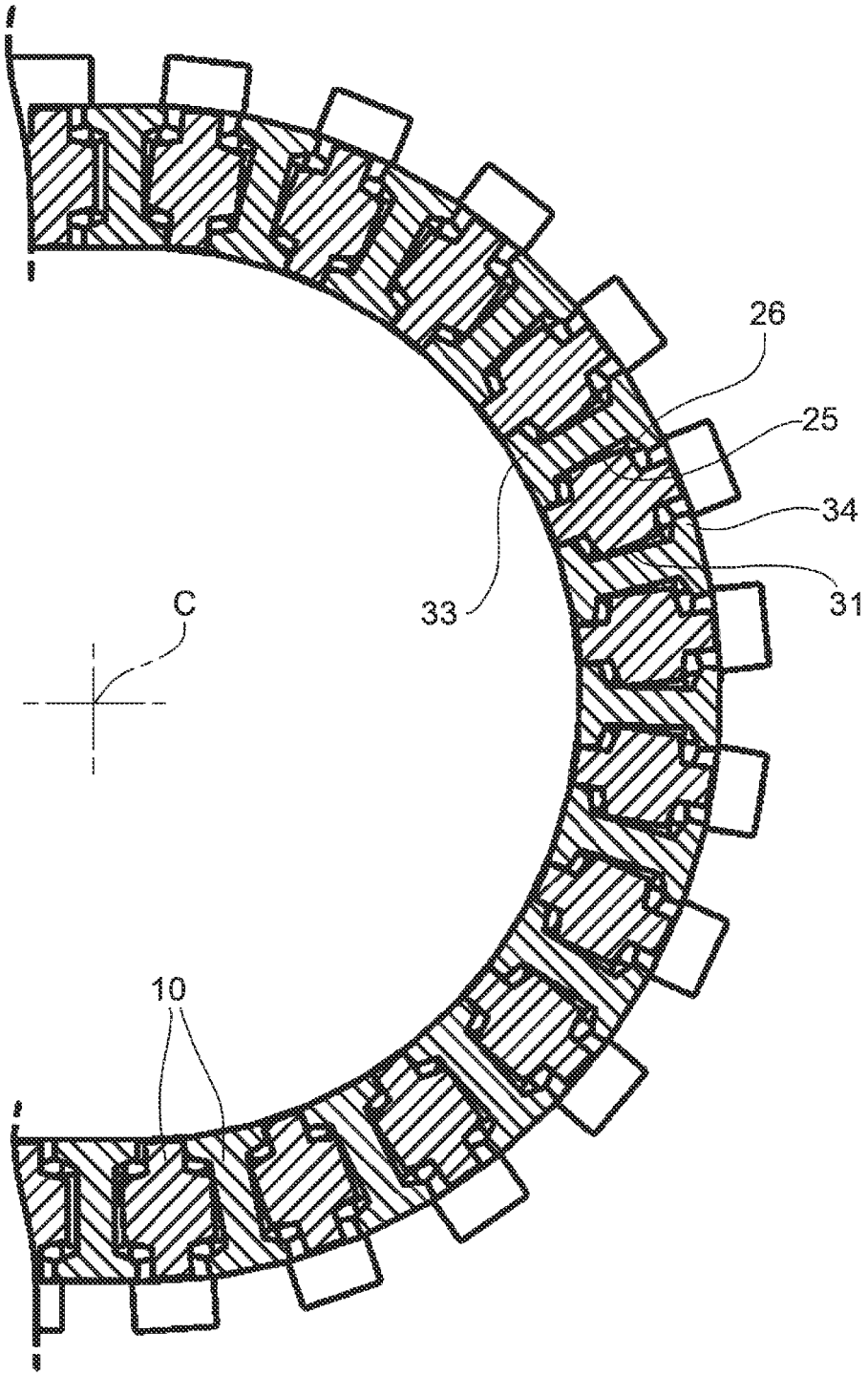
FIG. 15 is a cross-sectional view of a fastener chain in a bent condition.
Figure 16:
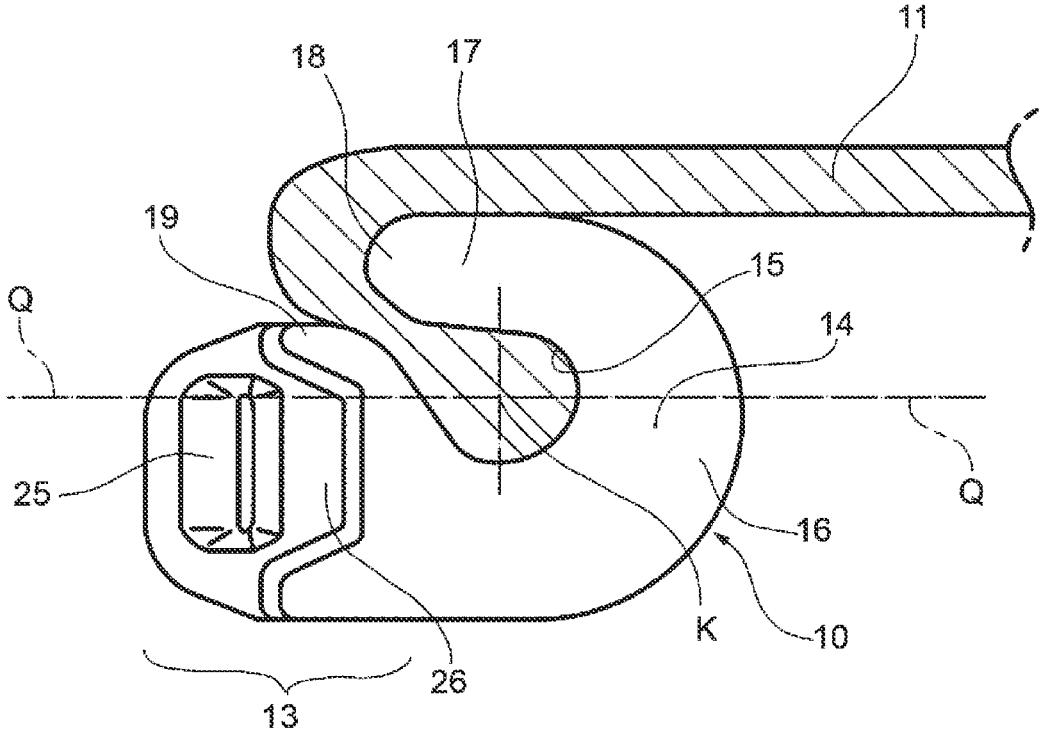
FIG. 16 is a cross-sectional view of a stringer with a fastener element according to a third embodiment of the present invention.

When the fastener tape in a closed condition is bent in a transversal plane, it takes a curved shape as shown in FIG. 15, describing an arc with a center C. In such a bent condition, the side of the engaging protrusions radially farther from the center C tend to partially emerge from the mating engaging recesses of the elements on the opposite stringer. As a result, the areas of contact between engaged elements is reduced. In order to suppress the elements from disengaging, and allow the two stringers to separate, embodiments may provide that the coupling portion 13 can be located closer to the fastener tape side (FIG. 16). Having defined the center of the Major arc shaped groove 15 for receiving the cord as K, the point K lies in a geometrical plane Q extending in the lengthwise and transversal directions. By forming the engaging protrusion 25 and the engaging recess 26 such that they are positioned so as to extend partially beyond the plane Q toward the fastener tape, the engaged areas of contact are increased when the fastener tape is bent in its closed condition.

Figure 17:
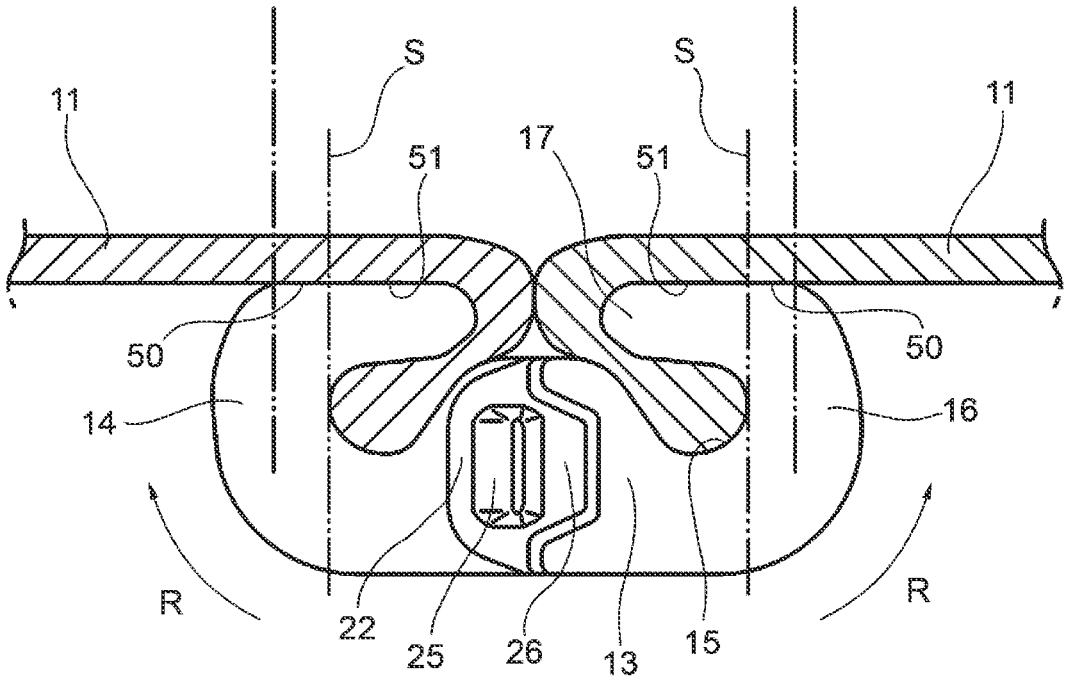
FIG. 17 is a cross-sectional view of a fastener chain with fastener elements according to a fourth embodiment of the present invention.

When the fastener element is crimped to the tape, the distal end portion 17 of the root portion 14 provides a flat side surface 51 that rests against the fastener tape 11. According to the embodiment shown in FIG. 17, the flat side surface 51 of the distal end portion 17 includes a proximal length 50 extending beyond a vertical lengthwise extending plane S tangent to the Major arc shaped groove 15 for receiving the cord. The proximal length 50 joins the distal end portion 17 to the bent portion 16 of the root portion 14. The proximal length 50 provides an additional surface for the fastener element to rest against the fastener tape 11. The proximal length 50 has the effect of more efficiently resisting rotary movement (as indicated by arrows R in FIG. 17) of the fastener elements when the fastener tape is bent in its closed condition (FIG. 15). The extra portion of flat surface provided by the proximal length 50, acting against the fastener tape 11, helps to exploit the reaction of the fastener tape and suppress the radially outer sides of the engaging protrusions 25, farthest from the center C of the bend, from coming out of the engaging recesses 26.

Figure 18:
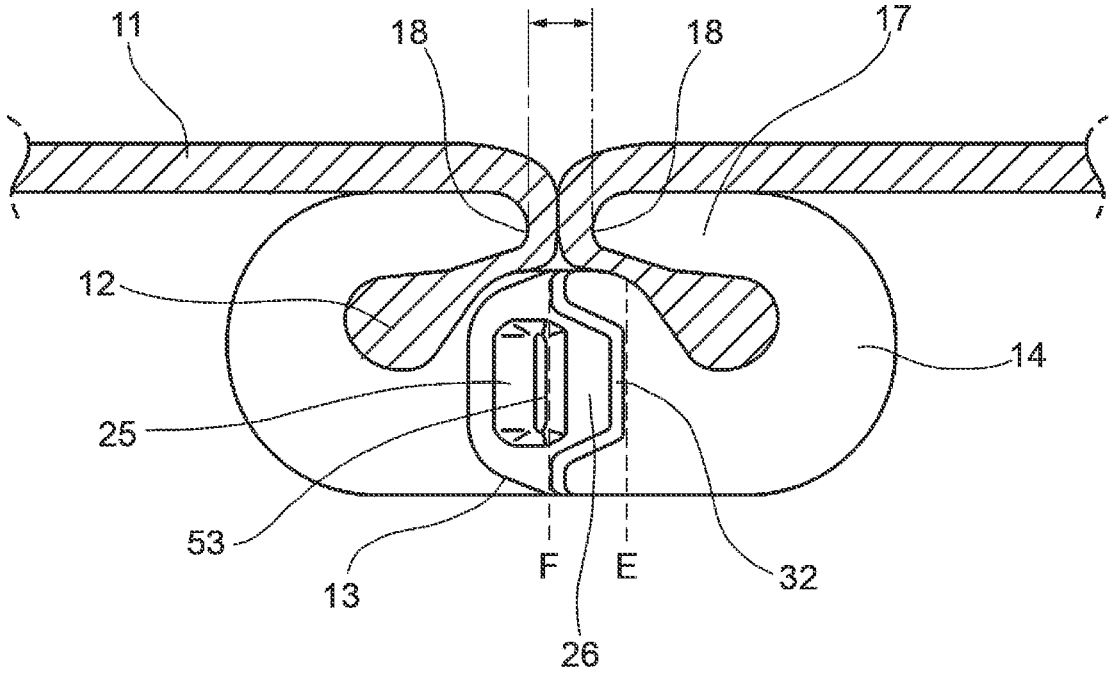
FIG. 18 is a cross-sectional view of a fastener chain with fastener elements according to a fifth embodiment of the present invention.

According to a further embodiment (FIG. 18), the tip 18 of the distal end 17 of the root portion 14 may extend in the transversal direction closer to the distal edge 28 of the coupling portion 13. Particularly, the tip 18 may lie in a lengthwise plane that extends across the engaging recess 26. This arrangement results in narrowing a gap G between the lengthwise planes in which the opposing tips 18 of the two rows of elements lie. A narrow gap G advantageously restrains rotary movement between the left and the right stringers, thereby suppressing an undue separation of the two stringers in an engaged condition of the slide fastener. In the exemplary embodiment of FIG. 18, the plane lies between lengthwise planes E and F which delimit transversally the recess 26 between the connecting wall 32 and the top ridge 53 of the engaging protrusion 25. A number of aspects and embodiments of a slide fastener element and a slide fastener stringer have been described. It is to be understood that each aspect and embodiment may be combined with any other aspect or embodiment. Particularly, it will be appreciated that the features described and illustrated herein in connection with the embodiments of a fastener element attached to a fastener tape may equally apply to corresponding embodiments of a fastener element in an undeformed state prior to bending its root portion and attaching it to the tape. Moreover, the invention is not restricted to the described embodiments, but may be varied within the scope of the accompanying claims and their legal equivalents.

This application is based on Italian Patent Application No. 102021000001706 filed on Jan. 28, 2021, the contents of which are incorporated herein by way of reference.

REFERENCE SIGNS LIST

10 fastener element, element
10L adjacent element
11 fastener tape, tape
11L left side fastener tape
11R right-side tape
12 cord
13 coupling portion, head portion
14 root portion
15 groove, Major arc shaped groove
16 bent portion
17 distal end portion
18 tip
19 side surface
20 convex side surface
20L convex side surface
21 body portion
22 distal plate portion
23, 24 opposite face
25 engaging protrusion
26 engaging recess
27 distal slope
28 distal edge
29 proximal slope
30 strip surface
31 bottom surface
32 connecting wall
33 side extension
34 side extension
35 central part
36, 37 sloping side
38, 39 passage
40, 41 opposite surface
42 central edge part
43, 44 side edge part
46 point
47 indentation
48 side shaped surface
51 side surface, flat side surface
52 second chamfer
53 top ridge
C center
C1, C2 thickness
E, F plane
G gap
O article
P pitch
Q plane
T lengthwise thickness
t lengthwise thickness
W1 vertical distance
W2 vertical distance

The invention claimed is:

1. A fastener element for a slide fastener, the fastener element comprising:

a coupling portion having two opposite faces in a lengthwise direction; and one single root portion extending from the coupling portion, the root portion either forming, or plastically bendable to form, a Major arc shaped groove for receiving and holding a length of a cord and an edge portion of a fastener tape, the root portion either comprising, or being plastically bendable to comprise, a bent portion and a distal end portion which extends from the bent portion towards a side of the coupling portion which is closer to the fastener tape, wherein each face of the coupling portion comprises an engaging protrusion protruding in the lengthwise direction, and an engaging recess recessed in the lengthwise direction with respect to its respective face, and is configured for receiving an engaging protrusion of a fastener element on an opposite stringer in a closed condition of the slide fastener, the coupling portion comprises a body portion connected to the root portion, and a distal plate portion extending from the body portion and providing the two opposite faces with the engaging protrusions and the engaging recesses, and the root portion has a first lengthwise thickness, and the distal plate portion has a second lengthwise thickness that is less than the first lengthwise thickness of the root portion.

2. A fastener element according to claim 1, wherein a connecting wall joining the body portion which is thicker than the distal plate portion to the distal plate portion which is narrower than the root portion extends from a side of the coupling portion closer to the fastener tape to an opposite side of the coupling portion farther from the fastener tape, the connecting wall defining two side extensions of the body portion extending toward the distal plate portion, whereby the engaging recess is defined between the relevant engaging protrusion, the side extensions, a central part of the connecting wall that joins the side extensions, and a bottom surface.

3. A fastener element according to claim 2, wherein one of the side extensions which is closer to the fastener tape has a first thickness, measured in a vertical direction, which is less than a second vertical thickness of the other side extension that is farthest from the fastener tape.

4. A fastener element according to claim 3, wherein the distal plate portion provides a distal edge comprising a central edge part and two inclined side edge parts that converge into the central edge part while tapering from the body portion, and the vertical thicknesses are measured at a level of the central part of the connecting wall, where the engaging recess is farthest from the distal edge of the coupling portion.

5. A fastener element according to claim 1, wherein the distal plate portion provides a distal edge comprising a central edge part and two inclined side edge parts that converge into the central edge part while tapering from the body portion, an inclined side edge part of the two inclined side edge parts which is located toward the fastener tape is radiused to the central edge part so as to form a radius, the body portion of the coupling portion forms a convex side surface facing the fastener tape, and the convex side surface protrudes vertically, in a vertical direction toward the fastener tape, more than the inclined side edge part of the two inclined side edge parts which is located toward the fastener tape.

6. A fastener element according to claim 1, wherein the distal plate portion provides a distal edge comprising a central edge part and two inclined side edge parts that converge into the central edge part while tapering from the body portion, and a vertical distance between the same engaging protrusion and the inclined side edge part of the coupling portion farthest from the fastener tape is shorter than a vertical distance between the engaging protrusion and the inclined side edge part of the coupling portion closer to the fastener tape.

7. A fastener element according to claim 1, wherein the distal plate portion provides a distal edge comprising a central edge part and two inclined side edge parts that converge into the central edge part while tapering from the body portion, and the coupling portion has a side edge part facing away from the fastener tape which is entirely formed as a slope which extends from the root portion to the distal edge of the distal plate portion, whereby when two stringers are in a coupled condition, an indentation having the shape of an obtuse angle is formed in a contour of the fastener element on each of the two stringers on the side of the fastener element farther from the fastener, when viewed in a lengthwise direction.

8. A fastener element according to claim 1, wherein the distal plate portion has a distal edge with a central edge part and two inclined side edge parts that converge into the central edge part while tapering from the body portion, and the coupling portion has an asymmetrical design in that each engaging protrusion is arranged closer to one of the inclined side edge parts facing away from the fastener tape, and is farther away from the other inclined side edge part which is facing the side of the fastener tape.

9. A fastener element according to claim 1, wherein the distal plate portion comprises a distal edge with a central edge part and two inclined side edge parts that converge into the central edge part while tapering from the body portion, a side shaped surface extending in the lengthwise direction along the central edge part and the two inclined side edge parts, and a first chamfer formed along one of the inclined side edge parts of the coupling portion farthest from the fastener tape, the first chamfer joining the side shaped surface to a first one surface of the two opposite faces of the distal plate portion, thereby reducing the lengthwise thickness of the distal plate portion along the inclined side edge part farthest from the fastener tape.

10. A fastener element according to claim 9, wherein the distal plate portion provides also a second chamfer formed along the inclined side edge part of the coupling portion farthest from the fastener tape, the second chamfer joining the side shaped surface to a second face, opposite to a first face of the two opposite faces of the distal plate portion, thereby further reducing the lengthwise thickness of the distal plate portion along the inclined side edge part farthest from the fastener tape.

11. A fastener element according to claim 1, wherein the distal end portion of the root portion provides a flat side surface that in use rests against the fastener tape, the Major arc shaped groove for receiving the cord defines a geometrical plane extending in vertical and lengthwise directions which is tangent to the Major arc shaped groove, and the flat side surface of the distal end portion comprises a proximal length which extend beyond the plane extending in vertical and lengthwise directions, and joins the distal end portion to the bent portion of the root portion.

12. A fastener element according to claim 1, wherein the fastener element has a symmetrical shape with respect to a midplane extending through the fastener element perpendicular to the lengthwise direction.

13. A fastener element according to claim 1, wherein the distal end portion of the root portion extends to form a tip located in a position overpassing a geometrical straight-line oriented in a transversal direction and tangent to a side surface of the coupling portion closer to the fastener tape.

14. A fastener element according to claim 13, wherein the tip of the root portion lies in a lengthwise plane that extends across the engaging recess.

15. A fastener element for a slide fastener, the fastener element comprising:

a coupling portion having two opposite faces in a lengthwise direction; and one single root portion extending from the coupling portion, the root portion either forming, or plastically bendable to form, a Major arc shaped groove for receiving and holding a length of a cord and an edge portion of a fastener tape, the root portion either comprising, or being plastically bendable to comprise, a bent portion and a distal end portion which extends from the bent portion towards a side of the coupling portion which is closer to the fastener tape, wherein each face of the coupling portion comprises an engaging protrusion protruding in a lengthwise direction, and an engaging recess recessed in the lengthwise direction with respect to its respective face, and is configured for receiving an engaging protrusion of a fastener element on an opposite stringer in a closed condition of the slide fastener, the Major arc shaped groove for receiving the cord defines a central point which lies in a geometrical plane extending in the lengthwise and transversal directions, and the engaging protrusion and the engaging recess extend partially beyond the plane toward the fastener tape.

16. A fastener stringer comprising:

slide fastener tape;

a cord attached along one edge of the slide fastener tape; and a row of slide fastener elements according to claim 1 clamped along the cord and one side edge portion of the fastener tape.

17. A fastener chain comprising:

a first stringer comprising a first fastener tape, a first cord, and a first row of fastener elements according to claim 1 clamped to the first cord and the first fastener tape; and a second stringer comprising a second fastener tape, a second cord, and a second row of fastener elements according to claim 1 clamped to the second cord and the second fastener tape and coupled to the first row of fastener elements, wherein the root portion of each fastener element provides two surfaces opposite in the lengthwise direction, and a geometrical plane in which any one of two opposite surfaces of a root portion of a first fastener element lies, extends between two geometrical planes in which the two opposite surfaces of a root portion of a second fastener element on the opposite stringer lie.

* * * * *